US006893213B1

(12) United States Patent
Quill et al.

(10) Patent No.: US 6,893,213 B1
(45) Date of Patent: May 17, 2005

(54) METHOD AND APPARATUS FOR ADJUSTING IMPELLER CLEARANCE IN A PUMP

(75) Inventors: Jeremiah D. Quill, Auburn, NY (US); Chadwick E. Tuttle, Victor, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 29 days.

(21) Appl. No.: 10/696,385

(22) Filed: Oct. 28, 2003

(51) Int. Cl.[7] ..... F01D 7/00

(52) U.S. Cl. ..... 415/131; 415/132; 415/214.1

(58) Field of Search ..... 415/131, 132, 415/214.1, 213.1, 126; 411/384, 385, 508

(56) References Cited

U.S. PATENT DOCUMENTS 3,711,218 A * 1/1973 Kennel et al. ..... 415/131
5,030,018 A * 7/1991 Korenblit ..... 384/519
5,951,244 A * 9/1999 Knight, Sr. ..... 415/132

* cited by examiner

*Primary Examiner*—Edward K. Look
*Assistant Examiner*—Dwayne J. White
(74) *Attorney, Agent, or Firm*—Ware, Fressola, Van Der Sluys & Adolphson LLP

(57) ABSTRACT

An impeller clearance adjustment system for providing for a desired clearance between an impeller and a housing by adjusting a spacing (10) between a thrust housing (11) and a frame (12) using a plurality of evenly-spaced shoulder screws (21) locked into a screwed-in position by respective lock nuts (22). A shoulder portion (21*a*) of each shoulder screw (21) keeps the thrust housing (11) from coming closer to the frame (12) than the adjusted spacing (10).

8 Claims, 3 Drawing Sheets

METHOD AND APPARATUS FOR ADJUSTING IMPELLER CLEARANCE IN A PUMP

TECHNICAL FIELD

The present invention pertains to the field of impeller pumps. More particularly, the present invention pertains to a system for adjusting the spacing between a thrust housing in a pump having an impeller and the frame of the pump, and so for adjusting the clearance between the impeller and a housing of the pump.

BACKGROUND ART

In a typical impeller pump—such as the Gould Model 3196 series of pumps produced by Gould's Pump, Inc., of Seneca Falls, N.Y.—a bearing housing/thrust housing and a bearing frame are two separate items attached to one another in spaced apart relation so as to have a desired spacing. The spacing in some such pumps determines the clearance between the impeller and a housing of the pump. The Gould Model 3196 (and also Model 3175 and 3180) are open impeller pumps, and include a system for adjusting the spacing between the thrust housing and bearing frame—and so the impeller clearance—that has now been in common use for over 30 years. A precise setting of impeller clearance is required to maintain pump efficiency.

The impeller clearance adjustment system used in these pumps is shown in FIG. 1 as including a plurality of evenly distributed jack bolts 14 and corresponding lock nuts 15, and also a plurality of evenly distributed locking bolts 16. The system of jack bolts 14 with lock nuts 15 and locking bolts 16 allows adjusting a spacing 10 between a thrust housing 11 and a frame 12 and so adjusting the clearance of an impeller (not shown) and a suction housing (also not shown) without disassembling the pump. Typically three evenly distributed jack bolts 14—distributed 120 degrees apart—are used, each having a lock nut 15 to fix the minimum separation 10 between the thrust housing 11 and the frame 12, and typically three locking bolts 16 are used—also distributed 120 degrees apart and offset by 60 degrees from the jack bolts—to hold the thrust housing to the frame. The locking bolts 16 fit through a clearance hole in a flange of the thrust housing and thread into the bearing frame. The jack bolts are threaded into the thrust housing flange and abut against the end of the bearing frame. The lock nuts are located between the head of the jack bolt and the thrust housing flange and are used to prevent the jack bolts from loosening during normal operation.

Some other adjusting arrangements involve shims between the thrust housing flange and the bearing frame. Such shim arrangements require that the pump be disassembled in order to adjust impeller clearance.

In addition, U.S. Pat. No. 5,951,244 to Knight, and also U.S. Pat. No. 6,368,053 also to Knight, describe an impeller clearance adjustment system that uses a plurality of pairs of adjustment bolts and mating attachment bolts to provide a desired spacing between thrust or bearing housing and a bearing frame (and so to provide impeller clearance adjustment). Both the thrust housing and the frame have evenly spaced apart pair-wise registerable threaded openings. A threaded adjustment bolt is threaded through an opening of the thrust housing and abuts the frame. The end of each adjustment bolt is squared and the cross section is greater than the cross section of each opening on the frame so that the adjusting bolt does not, and cannot, enter the opening of the frame. The adjustment bolt is dimensioned so that when each is fully inserted into its respective opening in the thrust housing, the impeller clearance is at the greatest desired distance. The attachment bolt is then passed through each aligned opening pair to hold the thrust housing to the frame. The '053 patent additionally describes a twinsert threadably installed in the threaded openings of the frame and also describes locking bolts each being threaded not into the frame itself, but instead into a twinsert (after being passed through a bore opening of a respective adjustment bolt). The holes in the flange of the thrust housing must be a sufficient size to accommodate relatively large diameter adjustment bolts so as to be able to have attachment bolts of sufficient diameter to provide reasonable strength. Since in some pumps the flange of the thrust housing is relatively small, such a design can be problematic.

It would therefore be advantageous to have an impeller clearance adjustment system simpler than the older above described system using both jack bolts and locking bolts, but also one able to provide a stronger attachment of the thrust housing to the frame, especially in case of a relatively small flange on the thrust housing.

DISCLOSURE OF THE INVENTION

Accordingly, in a first aspect of the invention, an apparatus is provided, comprising: a two-housing assembly including a first housing having a plurality of first spaced apart non-threaded openings, and including a second housing having a plurality of second spaced apart threaded openings registerable with the plurality of first spaced apart non-threaded openings; and means for holding the first housing and the second housing in a desired spaced-apart relation including a plurality of adjustment screws each having a shoulder portion and each passing through one of the plurality of first spaced-apart openings and threadably passing into one of the second spaced apart threaded openings in the second housing so as to have the shoulder portion disposed between the first housing and the second housing and so preventing movement of the first housing toward the second housing closer than a desired spacing.

In accord with the first aspect of the invention, the means for holding the first housing and the second housing in a desired spaced-apart relation may also include a plurality of lock nuts each threadably engaging a respective adjustment screw so as to lock the adjustment screw against screwing into or screwing out of the first housing when tightened until it abuts the second housing.

Also in accord with the first aspect of the invention, the first housing may have a flange and may have a recess in the flange for the shoulder portion of each adjustment screw suitable for accommodating all or part of the shoulder portion of the adjustment screw.

Also in accord with the first aspect of the invention, the apparatus may be a portion of a pump having an impeller, and the spaced apart relation may correspond to a spacing between the impeller and a suction housing.

Still also in accord with the first aspect of the invention, the shoulder portion may be formed as part of the attachment screw or may be provided as a separate washer or nut fixed in place on the attachment screw.

In a second aspect of the invention, a method is provided for holding a first housing and a second housing in a desired spaced-apart relation, comprising: a step of threading to a desired depth in a second housing a plurality of adjustment screws through a respective one of a plurality of threaded openings in the second housing; a step of pushing the first housing onto the plurality of adjustment screws so as to have each adjustment screw pass through a respective non-threaded opening in the first housing until a shoulder portion of each adjustment screw prevents further progress of the first housing onto the adjustment screw.

In accord with the first aspect of the invention, the method may further comprise a step of threading a plurality of lock nuts onto a respective one of the plurality of adjustment screws so as to lock the adjustment screw against screwing into or screwing out of the second housing when the lock nut is tightened up to the point where it abuts the first housing. The method may even further comprise a step of loosening the lock nuts, and screwing or unscrewing the attachment screws to a new desired depth in the second housing, and then re-tightening the lock nuts.

BRIEF DESCRIPTION OF THE DRAWINGS

The above and other objects, features and advantages of the invention will become apparent from a consideration of the subsequent detailed description presented in connection with accompanying drawings, in which.

BEST MODE FOR CARRYING OUT THE INVENTION

Figure 2:
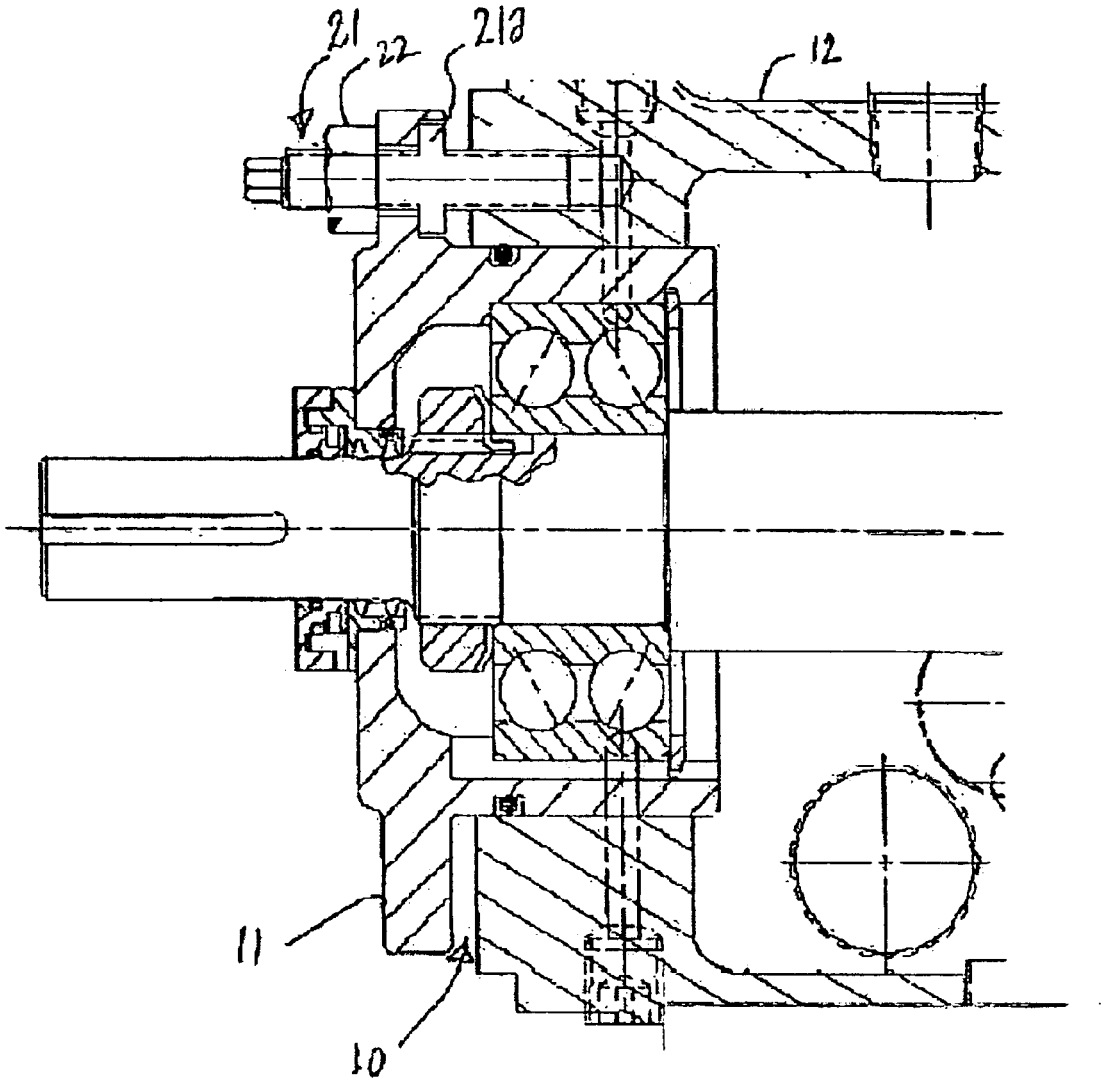
FIG. 2 is a cross section view of a thrust housing and a frame of an impeller pump including equipment according to the invention for impeller clearance adjustment.

Referring now to FIG. 2, an impeller adjustment system according to the invention is shown as including a shoulder screw 21 having a shoulder 21*a* for adjusting a separation 10 between a thrust housing 11 and a frame 12, and using a lock nut 22 for locking the shoulder screw after adjusting the spacing 10. Although only a single shoulder screw is shown in FIG. 2, there are typically three or more such shoulder screws, evenly distributed around the periphery of the thrust housing 11. The thrust housing 11 has a flange or outer portion, and when the thrust housing is oriented so as to attach to the frame 12, the frame side of the flange is formed so as to have a recess able to accommodate the shoulder 21*a* of the shoulder screw 21.

In first assembling an impeller pump so as to include the impeller clearance adjustment system provided by the invention, the shoulder screws are typically first screwed into threaded holes in the frame 12 so as to have a spacing 10 approximately of a desired size between the frame side of the shoulder 21*a* of each shoulder screw and the frame 12. The thrust housing 11 is then positioned so that holes in the thrust housing register with the shoulder screws 21, and the thrust housing is then pushed onto the shoulder screws until the shoulders 21*a* of the shoulder screws 21 stop the thrust housing from advancing further toward the frame 12. The lock nuts 22 for each shoulder screw are then generally screwed on but not tightened until a fine adjustment of the spacing 10 is made by turning the shoulder screw, which is adapted for turning by having either a hexagonal head, a square head, a socket head, or a screwdriver slot. Turning a threaded shoulder screw in combination with the respective lock nut (with the lock nut loose) will move the thrust housing 11 relative to the frame 12, and allow precise adjustment of the clearance between an impeller (not shown) and a housing (also not shown).

The shoulder 21*a* on the threaded shoulder screws 21 can be created as part of the shoulder screw 21 or can be provided as a separate washer or nut fixed in place on the screw.

Figure 3:
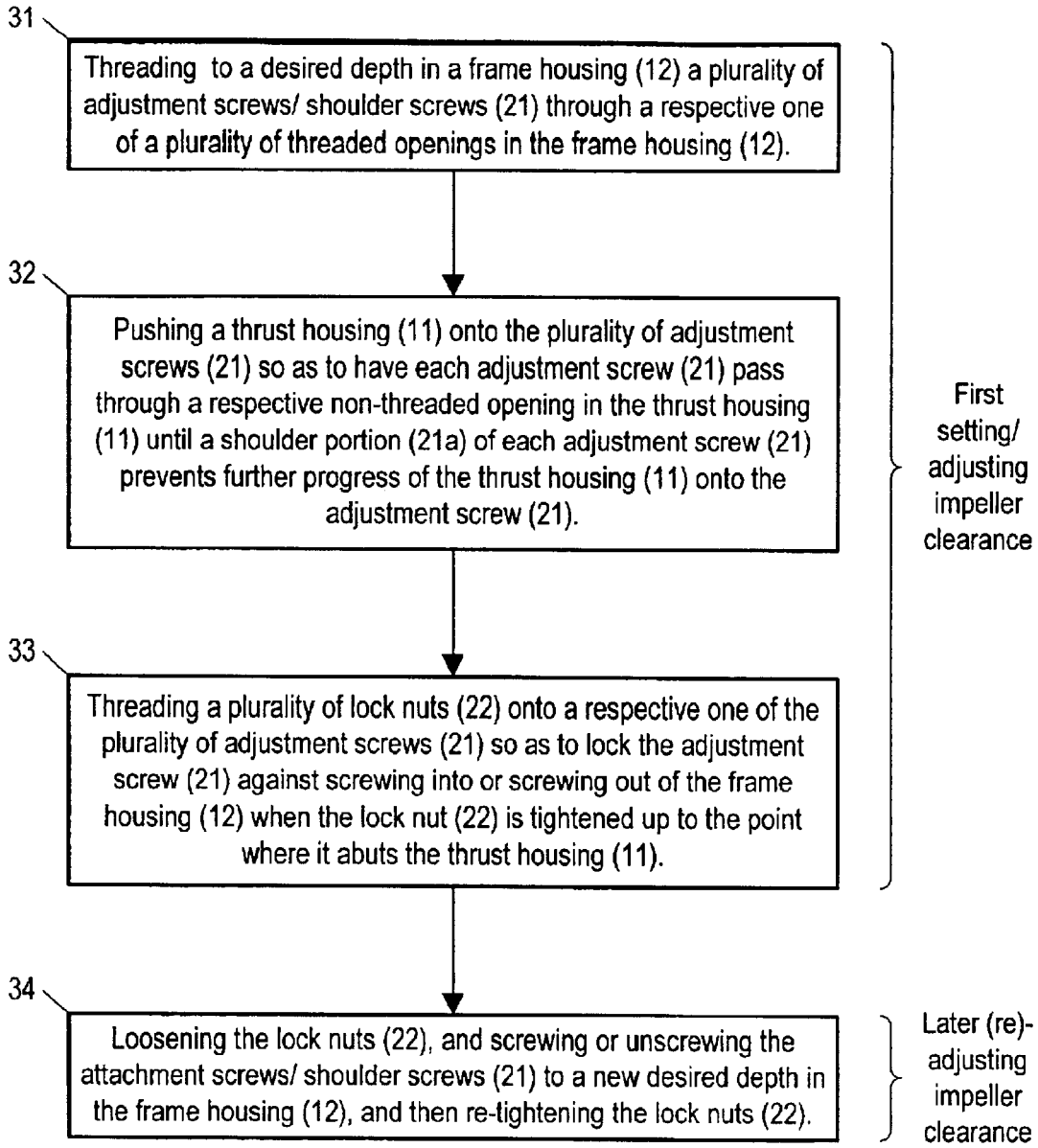
FIG. 3 is a flowchart of a method according to the invention for adjusting the spacing between the thrust housing and frame shown in FIG. 1, and thereby adjusting impeller clearance.

Referring now to FIG. 3, the use of the adjustment system provided by the invention is shown beginning with first attaching the thrust housing 11 to the frame 12 so as to have a desired spacing 10 (corresponding to a desired impeller clearance), and then readjusting the spacing 10 later in time, after it has changed or after the impeller clearance has changed or is deemed less than optimal. Thus, when first attaching the thrust housing 11 to the frame 12 (or in ever doing so again), a method of using the adjustment system provided by the invention includes a first step 31 of threading to a desired depth in the frame housing 12 each of a plurality of adjustment screws/shoulder screws 21 through a respective one of a plurality of threaded openings in the frame housing 12. The method then includes a next step 32 of pushing the thrust housing 11 onto the plurality of adjustment screws 21 so as to have each adjustment screw 21 pass through a respective non-threaded opening in the thrust housing 11 until a shoulder portion 21*a* of each adjustment screw 21 prevents further progress of the thrust housing 11 onto the adjustment screw 21. In a next step 33, a plurality of lock nuts 22 are threaded onto a respective one of the plurality of adjustment screws 21 so as to lock the adjustment screw 21 against screwing into or screwing out of the frame housing 12 when the lock nut 22 is tightened up to the point where it abuts the thrust housing 11. The spacing 10 is then fixed (but can change due to forces acting over time).

Still referring to FIG. 3, to adjust the spacing 10 to a new value (or to reset it to an earlier value after forces have acted to change it), a method according to the invention includes a step 34 of loosening the lock nuts 22, and screwing or unscrewing the attachment screws/shoulder screws 21 to a new desired depth in the frame housing 12, and then re-tightening the lock nuts 22.

Figure 1:
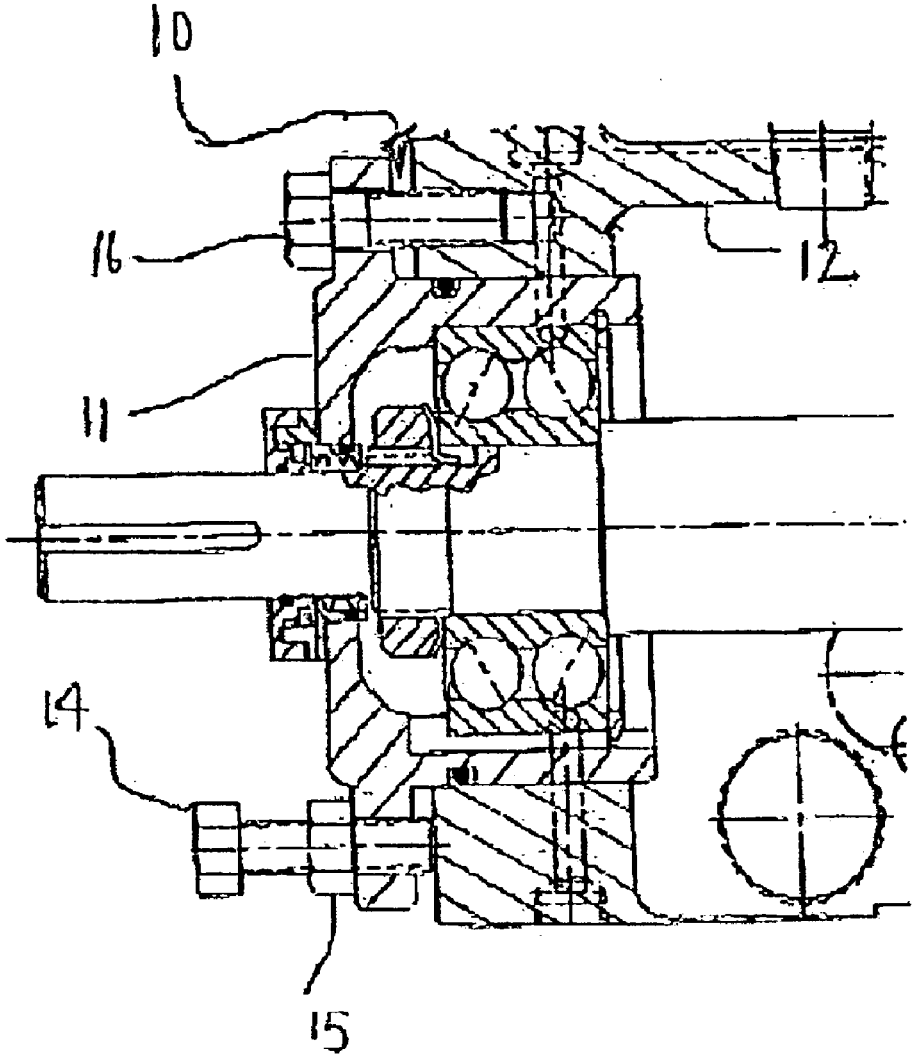
FIG. 1 (Prior Art)
FIG. 1 is a cross section view of a thrust housing and a frame of an impeller pump, and including equipment according to the prior art for impeller clearance adjustment.

The adjustment system provided by the invention combines into a single shoulder screw the function of the lock bolt 16 and jack bolt 14 (FIG. 1) of the older prior art system. Further, the invention improves the accuracy of the adjustment process by eliminating changes in clearance due to bolt stretch, since the locking force from the lock nut 22 is transmitted coaxially to the shoulder screw 21 whereas in the older prior art system the locking bolt 16 is off-axis from the jack bolt 14. Further still, the elimination of the extra equipment (typically three shoulder screws and lock nuts compared to three jack bolts and lock nuts and also three locking bolts in the early prior art, simplifies the adjustment process.

The invention also provides greater strength compared to the more recent prior art using adjustment screw with a longitudinal bore hole through which is passed an attachment bolt (as in U.S. Pat. Nos. 6,368,053 and 5,951,244, both mentioned above), since the shoulder screw can be relatively larger than the attachment bolt in the above-referenced patents in case of a small flange because the shoulder 21*a* need not be large in order to perform its function of preventing the thrust housing 11 from moving any closer to the frame 12 than is desired.

Advantageously, the invention does not require any modification to the frame or thrust housing of impeller pumps currently using the older adjustment system, except that a counter bore on the thrust housing may be provided to allow full travel of the thrust housing during adjustment (but the counter bore is not required if adequate clearance between the frame and the thrust housing flange is sufficient to allow for full adjustment).

As is clear from the above description, nothing about the invention limits it to use with centrifugal pumps, and indeed the invention is of use on any housing that must be precisely adjusted, not only on housings of centrifugal pumps.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. An apparatus, comprising:

a two-housing assembly including a first housing (11) having a plurality of first spaced apart non-threaded openings, and including a second housing (12) having a plurality of second spaced apart threaded openings registerable with the plurality of first spaced apart non-threaded openings; and means for holding the first housing (11) and the second housing (12) in a desired spaced-apart relation including a plurality of adjustment screws (21) each having a shoulder portion **(21*a*) and each passing through one of the plurality of first spaced-apart openings and threadably passing into one of the second spaced apart threaded openings in the second housing so as to have the shoulder portion (21*a*) disposed between the first housing (11) and the second housing (12) and so preventing movement of the first housing (11) toward the second housing (12)** closer than a desired spacing.

2. The apparatus of claim 1, wherein the means for holding the first housing (11) and the second housing (12) in a desired spaced-apart relation also includes a plurality of lock nuts (22) each threadably engaging a respective adjustment screw (21) so as to lock the adjustment screw against screwing into or screwing out of the first housing when tightened until it abuts the second housing (12).

3. The apparatus of claim 1, wherein the first housing (11) has a flange and has a recess in the flange for the shoulder portion **(21*a*) of each adjustment screw (21) suitable for accommodating all or part of the shoulder portion (21*a*) of the adjustment screw (21)**.

4. The apparatus of claim 1, wherein the apparatus is a portion of a pump having an impeller, and the spaced apart relation corresponds to a spacing between the impeller and a suction housing.

5. The apparatus of claim 1, wherein the shoulder portion **(21*a*) is formed as part of the attachment screw (21) or is provided as a separate washer or nut fixed in place on the attachment screw (21)**.

6. A method for holding a first housing (11) and a second housing (12) in a desired spaced-apart relation, comprising:

a step (31) of threading to a desired depth in a second housing (12) a plurality of adjustment screws (21) through a respective one of a plurality of threaded openings in the second housing (12); and a step (32) of pushing the first housing (11) onto the plurality of adjustment screws (21) so as to have each adjustment screw (21) pass through a respective non-threaded opening in the first housing (11) until a shoulder portion **(21*a*) of each adjustment screw (21) prevents further progress of the first housing (11) onto the adjustment screw (21)**.

7. The method of claim 6, further comprising a step (33) of threading a plurality of lock nuts (22) onto a respective one of the plurality of adjustment screws (21) so as to lock the adjustment screw (21) against screwing into or screwing out of the second housing (12) when the lock nut (22) is tightened up to the point where it abuts the first housing (11).

8. The method of claim 7, further comprising a step (34) of loosening the lock nuts (22), and screwing or unscrewing the attachment screws (21) to a new desired depth in the second housing (12), and then re-tightening the lock nuts (22).

* * * * *